US005531433A

United States Patent [19]

Hawkes et al.

[11] Patent Number: 5,531,433

[45] Date of Patent: Jul. 2, 1996

[54] SHEET MATERIAL HANDLING APPARATUS

[75] Inventors: Richard B. Hawkes, Bethlehem, Pa.; Michael C. Buschhaus, Springboro, Ohio

[73] Assignee: AM International, Inc., Mount Prospect, Ill.

[21] Appl. No.: 324,252

[22] Filed: Oct. 17, 1994

[51] Int. Cl.[6] ..... B65H 5/12

[52] U.S. Cl. ..... 271/10.01

[58] Field of Search ..... 271/10.01, 10.1, 271/10.11, 109, 82, 277, 114

[56] References Cited

U.S. PATENT DOCUMENTS

| | | | |
|---|---|---|---|
| 2,192,916 | 3/1940 | Kaddeland et al. . | |
| 3,650,525 | 3/1972 | Hageman et al. | 271/29 |
| 4,132,403 | 1/1979 | Weisbach et al. . | |
| 4,290,595 | 9/1981 | Thunker . | |
| 4,629,175 | 12/1986 | Fischer et al. | 271/202 |
| 4,993,702 | 2/1991 | Jackson . | |
| 5,207,412 | 5/1993 | Coons, Jr. et al. | 270/1.1 |
| 5,375,834 | 12/1994 | Rathert | 271/310 |
| 5,452,886 | 9/1995 | Cote et al. | 271/270 |

*Primary Examiner*—William E. Terrell
*Assistant Examiner*—Tamera Kelly
*Attorney, Agent, or Firm*—Tarolli, Sundheim, Covell, Tummino & Szabo

[57] ABSTRACT

A sheet material feed drum has a plurality of grippers which are spaced apart by a first distance, measured along the periphery of the feed drum. Sheet material is transferred from the feed drum to a conveyor. The conveyor has a plurality of pusher elements which are spaced apart by a second distance which is less than the first distance. The pusher elements are moved at a slower speed than the grippers. An apparatus is provided to reduce the speed of movement of the sheet material to match the speed of movement of the pusher elements. In one embodiment, the apparatus for changing the speed of movement of the sheet material includes a ring member which is rotatable about a central axis of the feed drum. The ring member is moved at a slower speed than the grippers. A presser roll engages the ring member to define a nip through which the sheet material is conducted. In another embodiment, a wheel is rotatable about an axis which extends through the feed drum. A presser roll engages the periphery of the wheel to form a nip through which the sheet material is conducted.

22 Claims, 5 Drawing Sheets

SHEET MATERIAL HANDLING APPARATUS

BACKGROUND OF THE INVENTION

The present invention relates to a new and improved sheet material handling apparatus and more specifically to a sheet material handling apparatus in which sheet material is transferred from a feed drum to a conveyor.

Through a process of trying various speed relationships in known sheet material handling apparatus, it has been determined that when sheet material is initially fed to a conveyor by a feed drum, the speed of movement of the sheet material should nearly match the speed of movement of pusher elements in the conveyor. However, in order to maximize performance of the sheet material handling apparatus, it is also desirable to have a greater distance, as measured along the periphery of the feed drum, between sheet material gripper elements on the feed drum than between pusher elements on the conveyor.

Thus, in order to maximize the performance of a sheet material handling apparatus, it has been determined that the pusher elements in the conveyor should be spaced apart by about two inches more than the maximum length of a sheet material article. However, the gripper elements on the feed drum must be spaced apart along the periphery of the drum by approximately five inches more than the length of the sheet material article. This results in a velocity mismatch between the feed drum and the conveyor. This velocity mismatch is not acceptable for high speed operation.

It has previously been suggested that the velocity of the feed drum and/or the conveyor be varied to eliminate the velocity mismatch between the feed drum and the conveyor. This has resulted in the use of relatively complex speed control devices. One such speed control device is disclosed in U.S. Pat. No. 4,993,702 in which a planetary gear system is utilized to vary the speed of a feed drum. Other known speed control devices for use in sheet material handling systems are disclosed in U.S. Pat. Nos. 2,192,916; 4,132,403; and 4,290,595.

SUMMARY OF THE INVENTION

The present invention provides a new and improved apparatus for changing the speed of movement of sheet material which is transferred from a feed drum to a conveyor. The apparatus includes a nip into which a leading edge portion of sheet material is moved by the feed drum. The sheet material moves through the nip toward the conveyor at a speed which is the same as the speed of the conveyor.

In one embodiment of the invention, the apparatus includes a ring member which is supported on the feed drum and is rotatable about a central axis of the feed drum. A presser roller engages a peripheral surface on the ring member at the transfer station to form the nip through which the sheet material passes. In another embodiment of the invention, a generally circular member is rotated about an axis which is offset from the axis of the feed drum and which extends through the feed drum. A presser roller engages a peripheral surface on the circular member at the transfer station to form the nip through which the sheet material passes.

BRIEF DESCRIPTION OF THE DRAWINGS

The foregoing and other features of the present invention will become more apparent upon a consideration of the following description taken in connection with the accompanying drawings wherein.

DESCRIPTION OF SPECIFIC PREFERRED EMBODIMENTS OF THE INVENTION

Figure 1:
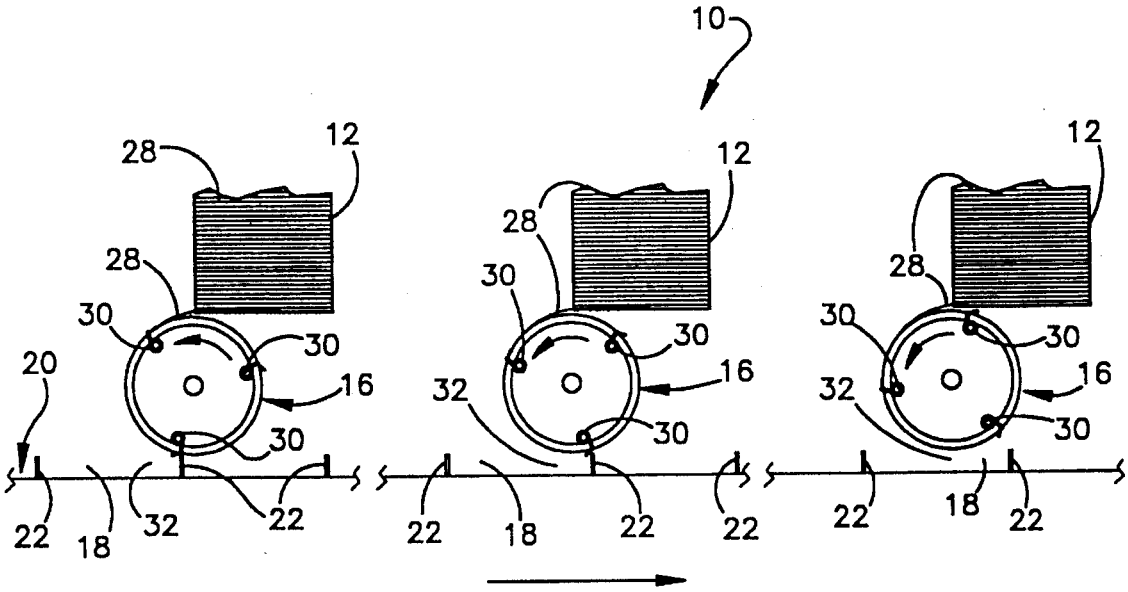
FIG. 1 is a highly schematicized illustration depicting the relationship between a plurality of sheet material supply hoppers, feed drums, and a conveyor.

A sheet material handling apparatus 10 (FIG. 1) includes a plurality of sheet material supply hoppers 12. Each of the supply hoppers 12 holds a stack of sheet material with flat major side surfaces of the sheet material in horizontal planes. Cylindrical feed drums 16 move sheet material from the supply hoppers 12 to receiving locations 18 in a conveyor 20. The receiving locations 18 in the conveyor 20 are disposed between pusher elements 22 which are moved along a raceway 24 (FIG. 2) by a conveyor chain 26 which extends between the pusher elements.

Each of the identical feed drums 16 (FIG. 1) is rotatable about its central axis to sequentially move grippers 30 along a continuous circular path which is disposed between one of the supply hoppers 12 and the conveyor 20. As grippers 30 are moved adjacent to a supply hopper 12 by a feed drum 16, the grippers are operated from an open condition to a closed condition to grip a sheet material article 28 in the supply hopper. Continued rotation of the feed drum 16 pulls the sheet material article 28 from the supply hopper 12 and moves it toward the conveyor 20.

When a gripper 30 has moved to a transfer station 32 disposed between a feed drum 16 and the conveyor 20, the gripper is opened to release the sheet material article 28 for movement to a receiving location 18 on the conveyor 20. The general manner in which the feed drum 16 cooperates with the supply hopper 12 and conveyor 20 is well known and is similar to that disclosed in U.S. Pat. Nos. 3,650,525 and 3,702,187.

Figure 2:
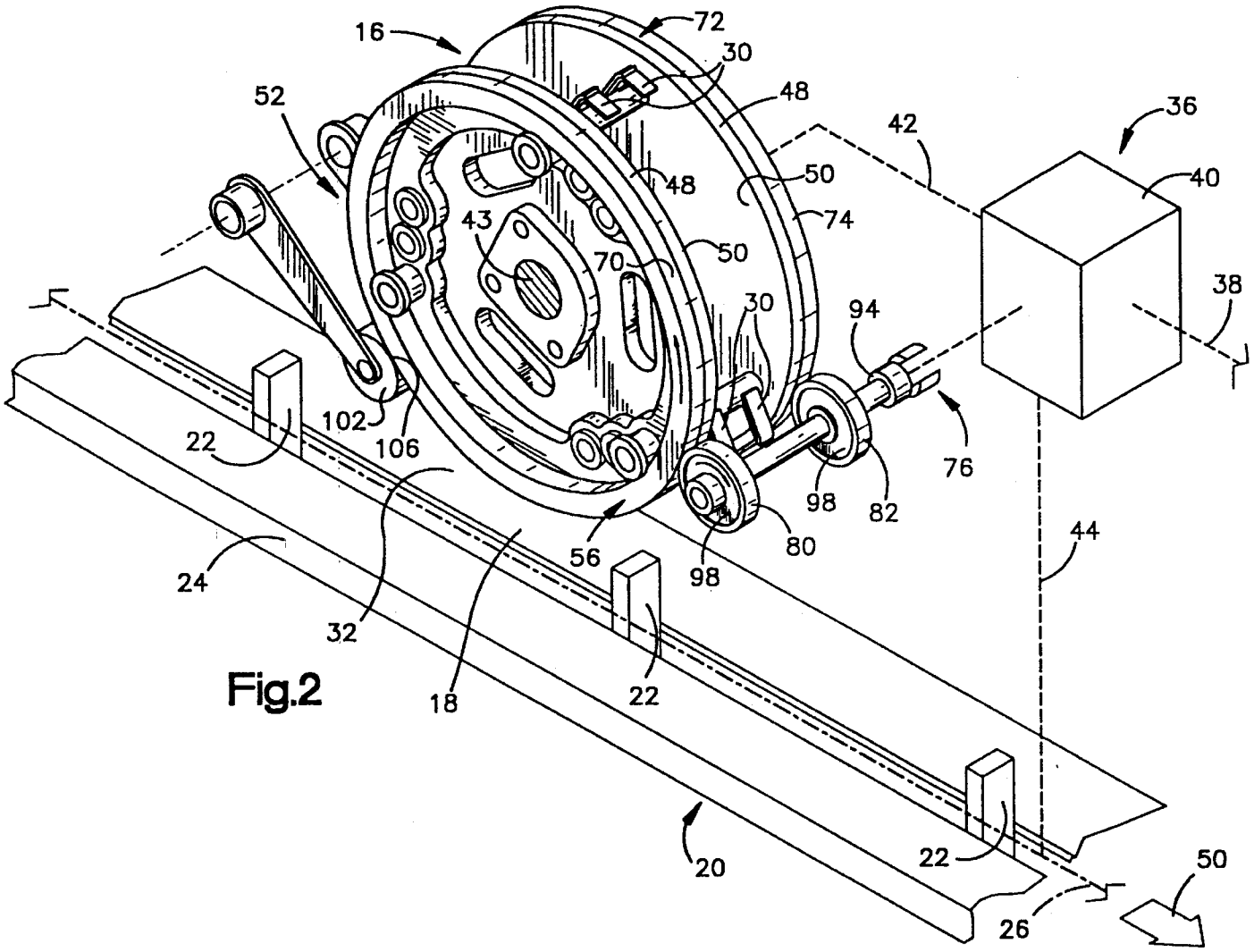
FIG. 2 is a schematic pictorial illustration depicting the relationship between one of the feed drums and the conveyor.

The conveyor 20 and each of the feed drums 16 are driven by a drive assembly 36 (FIG. 2). The drive assembly 36 includes a main drive 38 to a transmission 40. The transmission 40 drives the feed drums 16 through a feed drum drive system 42. The feed drum drive system 42 rotates a support shaft 43 which is connected with the feed drum 16.

In addition, the transmission 40 drives the conveyor 20 through a conveyor drive system 44. Since the main drive system 38 drives the feed drum drive system 42 for the feed drums 16 and the conveyor drive system 44 for the conveyor 20, the speed of operation of the conveyor 20 and the speed of rotation of the feed drums 16 vary with variations in the speed of operation of the main drive system 38.

Figure 3:
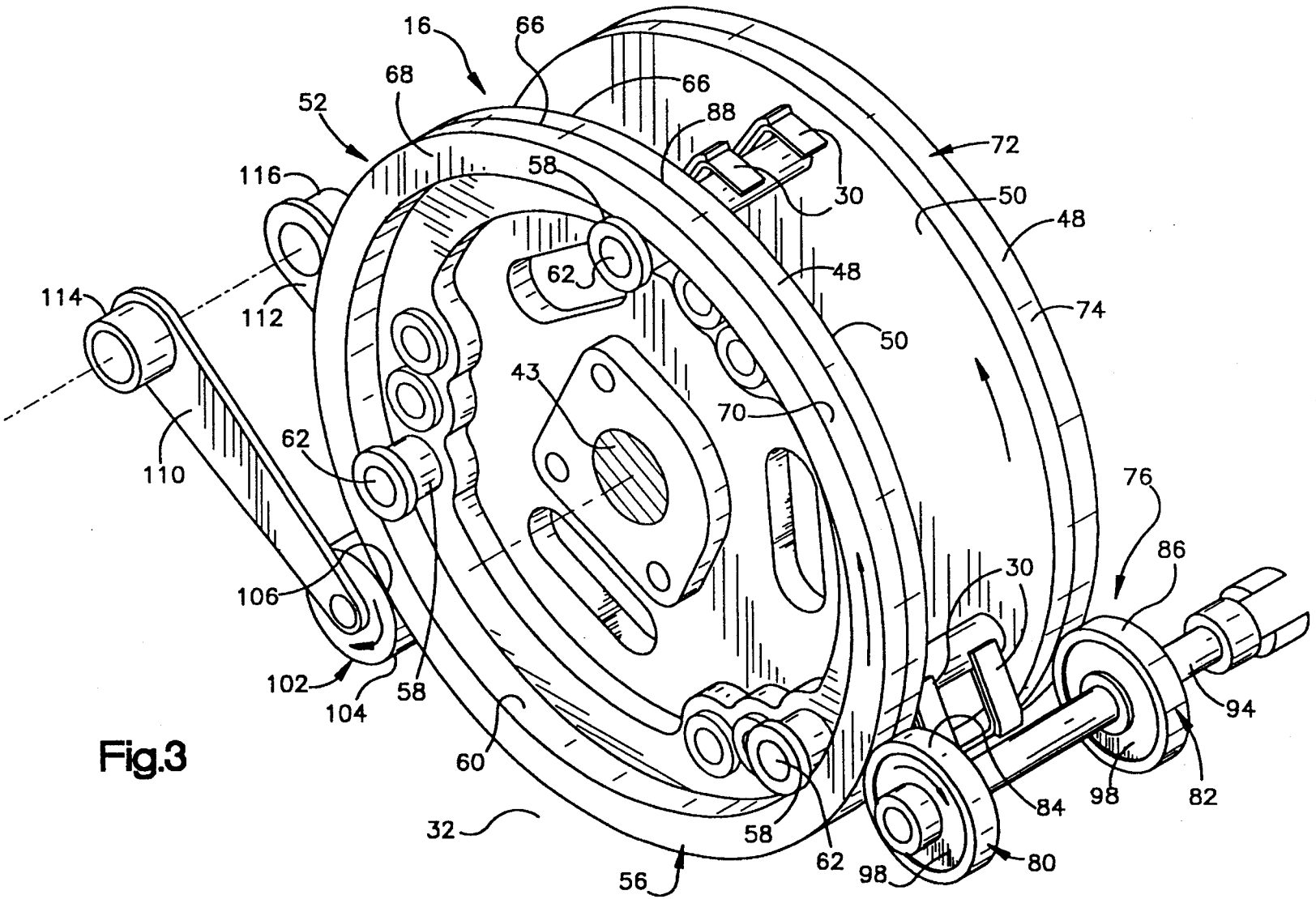
FIG. 3 is an enlarged schematic pictorial illustration of the feed drum of FIG. 2.

Each of the identical feed drums 16 has a plurality of sets of grippers 30 (FIG. 3). In the illustrated embodiment of the invention, each of the feed drums 16 has three sets of grippers 30 disposed at equally spaced apart locations along peripheral surfaces 48 on parallel side walls 50 of the feed drum. Thus, each of the sets of grippers is spaced apart by an arcuate distance of 120° about the peripheral surface 48 of the feed drum 16. Of course, a greater or lesser number of sets of grippers could be provided on a feed drum if desired.

In the specific embodiment of the invention illustrated in FIGS. 2 and 3, the feed drum 16 was used to feed sheet material articles 28 having a maximum length of approximately thirteen inches. Each set of grippers 30 was spaced from a next adjacent set of grippers by a distance of approximately eighteen inches along the circular peripheral surface 48 of the feed drum 16. The space between sets of grippers exceeded the maximum length of the sheet material by five inches. The extra five inches of space along the peripheral surface 48 of the feed drum 16 between the grippers 30 is necessary in order to accommodate feeding and gripping of the sheet material by the grippers during rotation of the feed drum 16.

Of course, the feed drum 16 could be constructed so as to accommodate a different maximum length of sheet material article and have a different spacing between sets of grippers. Regardless of the maximum size of the sheet material article 28 which the feed drum 16 is constructed to accommodate, the distance between the grippers 30, as measured along the peripheral surface 48 of the feed drum, will exceed the maximum length of the sheet material article in order to accommodate the operation of the grippers 30 during rotation of the feed drum.

When the grippers 30 move to a transfer station 32, the grippers are operated from a closed condition gripping a sheet material article 28 to an open condition releasing a sheet material article at the transfer station. The released sheet material article 28 moves into a receiving location 18 (FIG. 2) between a pair of pusher elements 22 in the conveyor 20. The pusher elements 22 engage a trailing end portion of the sheet material article 28 and push the sheet material article along the raceway 24 in the conveyor 20 in the direction of the arrow 50.

In order to maximize the speed of operation of the sheet material handling apparatus 10 (FIG. 1), the pusher elements 22 are spaced apart by a distance which is less than the spacing between the grippers 30. In the specific embodiment previously referred to in which the feed drum 16 was used to feed sheet material having a maximum length of thirteen inches, the pusher elements 22 were spaced apart by a distance of fifteen inches, as measured along the conveyor 20. The grippers 30 were spaced apart by a distance of eighteen inches, as measured along the periphery of the feed drum 16.

The distance between the pusher elements 22, as measured along the raceway 24 (FIG. 2), is less than the distance between sets of grippers 30, as measured along the peripheral surface 48 of the feed drum 16. Thus, in the specific embodiment previously referred to, the distance which the grippers 30 are spaced apart along the peripheral surface 48 of the feed drum 16 was three inches greater than the distance which the pusher elements 22 are spaced apart along the raceway 24. This results in a feed drum 16 moving each sheet material article 28 three inches further in each feed cycle than the conveyor 20.

To enable the feed drum 16 to move a sheet material article 28 through a greater distance (three inches) than the conveyor 20 on each feed cycle, the peripheral surface speed of the feed drum must be greater than the speed of movement of the pusher elements 22 in the conveyor 20. However, it is desirable to have the speed of movement of the sheet material article 28 be the same as the speed of movement of the pusher elements 22 when the sheet material article is fed into a receiving location 18 in the conveyor 20.

In accordance with a feature of the present invention, an apparatus 52 (FIGS. 2 and 3) is provided to change the speed of movement of a sheet material article 28 from the speed of movement of the grippers 30 on the feed drum 16 to the speed of movement of the pusher elements 22 in the conveyor 20. Thus, in the illustrated embodiment of the invention, the apparatus 52 slows the speed of movement of a sheet material article 28 from the relatively high speed at which the grippers 30 are moved by the feed drum 16 to the relatively low speed at which the pusher elements 22 are moved by the conveyor 20. However, it is contemplated that in a different environment, the speed of movement of the conveyor 20 may exceed the speed at which a sheet material article is moved by the feed drum 16. In this environment, the apparatus 52 would be utilized to increase the speed of movement of the sheet material article to match the speed of operation of the conveyor.

In the embodiment of the invention illustrated in FIG. 3, the apparatus 52 includes an annular ring member 56 which is rotatably mounted on the feed drum 16 in a coaxial relationship with the feed drum. The metal ring member 56 is supported on the feed drum 16 by a plurality of rollers 58. The rollers 58 are disposed in a circular array about a cylindrical radially inner side 60 of the annular ring member 56. The rollers 58 are rotatable about support pins 62 which are fixedly connected with a side wall 50 of the feed drum 16.

The annular ring member 56 has a pair of parallel flat side surfaces 66 and 68. The axially inner flat side surface 66 is disposed in engagement with a flat side surface on the circular feed drum side wall 50. The rollers 58 support the ring member 56 for rotation along the side wall 50 of the feed drum 16 with the flat side surface 68 of the ring member 56 in engagement with a flat side surface of the side wall. The central axis of the ring member 56 is coincident with the central axis of the feed drum 16.

The annular ring member 56 (FIG. 3) has a cylindrical peripheral surface 70 with the same diameter as a cylindrical peripheral surface 48 of the feed drum side wall 50. The cylindrical peripheral surface 70 of the annular ring member 56 has a central axis which is coincident with the central axis of the feed drum 16. The cylindrical peripheral surface 70 of the ring member 56 extends into the transfer station 32.

A second ring member 72 is disposed on a side of the feed drum 16 opposite from the ring member 56. The second ring member 72 has the same configuration and is rotatably supported in the same manner as the ring member 56. Thus, a plurality of support rollers, corresponding to the support rollers 58, support the ring member 72 in a coaxial relationship with the feed drum 16 and enable the ring member 72 to rotate about the central axis of the feed drum. The ring member 72 has a cylindrical peripheral surface 74 which is the same size as and is coaxial with the cylindrical peripheral surface 70 on the ring member 56.

A ring member drive system 76 is connected with the transmission 40 (FIG. 2) and is operable to rotate the ring members 56 and 72 relative to the feed drum 16. In the illustrated embodiment of the invention, the pusher elements 22 in the conveyor 20 move slower than the grippers 30. Therefore, the drive system 76 rotates the ring members 56 and 72 at a slower rate than the rate at which the feed drum drive system 42 rotates the feed drum 16. The drive system 76 rotates the ring members 56 and 72 at a rate such that the speed of movement of cylindrical peripheral surfaces 70 and 74 on the ring members 56 and 76 is the same as the speed of movement of pusher elements 22 in the conveyor 20.

The drive system 76 (FIG. 3) includes a pair of drive wheels 80 and 82. The drive wheels 80 and 82 have cylindrical peripheral surfaces 84 and 86 which are disposed in engagement with cylindrical peripheral surfaces 70 and 74 on the ring members 56 and 72. Although the cylindrical peripheral surfaces 70 and 74 of the ring members 56 and 72 are the same diameter as the peripheral surfaces 48 on the side walls 50 of the feed drum 16, the peripheral surfaces 84 and 86 of the drive wheels 80 and 82 do not engage the peripheral surfaces on the side walls of the feed drum 16. Thus, the peripheral surfaces of the drive wheels 80 and 82 engage only the cylindrical peripheral surfaces 70 and 74 of the ring members 56 and 72.

A drive shaft 94 is driven by the transmission 40 (FIG. 2) to rotate the drive wheels 80 and 82 in a clockwise direction as viewed in FIG. 3. The speed at which the drive shaft 94 rotates the drive wheels 80 and 82 is such that the ring members 56 and 72 rotate in a counterclockwise direction at a speed which is less than the speed of rotation of the feed drum 16 in a counterclockwise direction. The ring members 56 and 72 are driven at a speed such that their peripheral surfaces 70 and 74 move at the same speed as the pusher elements 22 in the conveyor 20.

Figure 4:
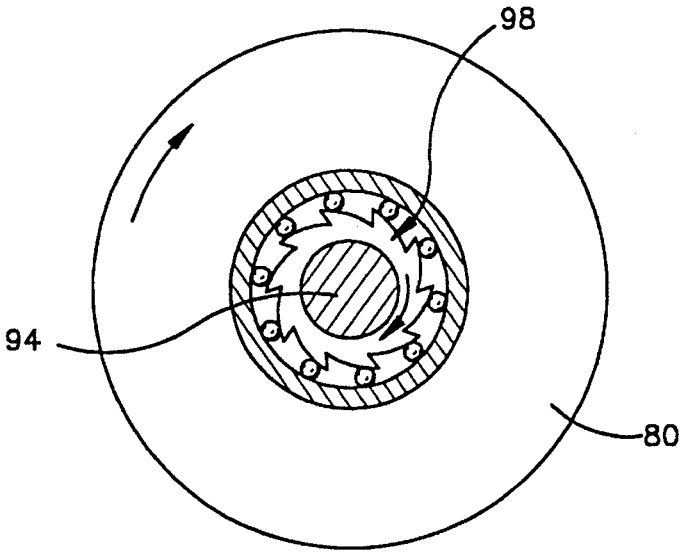
FIG. 4 is a schematic illustration of an overrunning clutch used in the apparatus of FIG. 3.

Force is transmitted from the drive shaft 94 to the drive wheels 80 and 82 through overrunning clutches 98. Thus, an overrunning clutch 98 (FIG. 4) is provided between the drive shaft 94 and the drive wheel 80. A similar overrunning clutch is provided between the drive shaft 94 and the drive wheel 82. The overrunning clutches 98 allow the speed of rotation of the ring members 56 and 72 and the speed of rotation of the drive wheels 80 and 82 to be momentarily increased under the influence of force transmitted from the sheet material to the ring members 56 and 72. Thus, the speed of rotation of the drive wheels 80 and 82 may, momentarily, exceed the speed of rotation of the drive shaft 94.

A presser roller 102 (FIG. 3) is rotatable about an axis which is offset to one side of the feed drum 16 and extends parallel to the central axis of the feed drum. The presser roller 102 has a cylindrical peripheral surface 10,4 which engages the peripheral surface 70 of the ring member 56 to form a nip 106 at the transfer station 32. Since the ring member 56 is rotating in a counterclockwise direction as viewed in FIG. 3, the presser roller 102 is rotated in a clockwise direction by the ring member.

The axial extent of the peripheral surface 104 of the presser roller 102 is such that the presser roller engages only the peripheral surface 70 of the ring member 56. The presser roller 102 does not engage the peripheral surface 48 of the feed drum 16. Although only a single presser roller 102 has been shown in FIG. 3, it should be understood that a second presser roller, having the same construction as the presser roller 102, engages the peripheral surface 74 of the ring member 72 to form a second nip at the transfer station 32 on the axially opposite side of the feed drum 16 from the nip 106.

The presser rollers 102 are rotatably supported by a pair of support arms 110 and 112. The support arms 110 and 112 are rotatably supported by the shafts 114 and 116. Suitable springs (not shown) urge the support arms 110 and 112 upward (as viewed in FIG. 3) to press the rollers 102 against the peripheral surfaces 70 and 74 of the ring members 56 and 72.

In the previously described specific embodiment of the feed drum 16 in which the sets of grippers 30 are spaced apart by a distance of eighteen inches along the peripheral surface 48 of the feed drum and the pusher elements 22 were spaced apart by a distance of fifteen inches along the raceway 24 of the conveyor 20, the drive wheels 80 and 82 rotate the ring members 56 and 72 at a slower speed than the speed at which the feed drum 16 is driven by the feed drum drive system 42. In this specific embodiment of the invention, the speed of movement of the grippers 30 and peripheral surface 48 on the feed drum 16 was 1.2 times the speed of movement of the peripheral surfaces 70 and 74 on the ring members 56 and 72. Thus, the peripheral speed of the ring members 56 and 72 and the speed of movement of the pusher elements 22 in the conveyor 20 was approximately 83% less than the speed of movement of the grippers 30 on the feed drum 16.

Since the ring members 56 and 72 are driven at a slower speed and in the same direction as the feed drum 16, the sheet material is decelerated when it enters the nip 106 between the presser rollers 102 and the ring members 56 and 72. When a leading edge portion of a sheet material article 28 enters the nip 106 between the presser rollers 102 and the ring members 56 and 72, the grippers 30 are immediately opened. This interrupts the transfer of force from the feed drum 16 to the sheet material article. The slower moving ring members 56 and 72 cooperate with the presser rollers 102 to decelerate the sheet material article to a speed which is the same as the speed of movement of the pusher members 22 in the conveyor 20 before the sheet material article is deposited in a receiving location 18 (FIGS. 1 and 2) along the conveyor 20.

As the leading edge portion of the sheet material article 28 moves into the nip 106 (FIG. 3) between the presser rollers 102 and the ring members 56 and 72, the sheet material article may momentarily cause the ring members 56 and 72 to tend to accelerate. This momentary acceleration is accommodated by the overrunning clutches 98 between the drive wheels 80 and 82 and the drive shaft 94. However, any acceleration of the ring members 56 and 72 is only momentary and the ring members quickly slow down to have a peripheral speed which is the same as the speed of movement of the pusher elements 22 in the conveyor 20.

When a sheet material article 28 is to be fed from a supply hopper 12 (FIG. 1) by the feed drum 16, the grippers 30 in one of the sets of grippers is operated to a closed condition to grip an edge portion of the sheet material article. Continued counterclockwise rotation of the feed drum 16 (as viewed in FIG. 1) results in the sheet material article 28 being pulled from the supply hopper 12 by the feed drum 16. As the feed drum 16 continues to rotate, the leading edge portion of the sheet material article 28 moves into the nip 106 (FIG. 3) between the presser rollers 102 and the ring members 56 and 72. The ring members 56 and 72 are both being rotated in the same direction, counterclockwise as viewed in FIG. 3, and at a lower speed than the feed drum 16.

Figure 5:
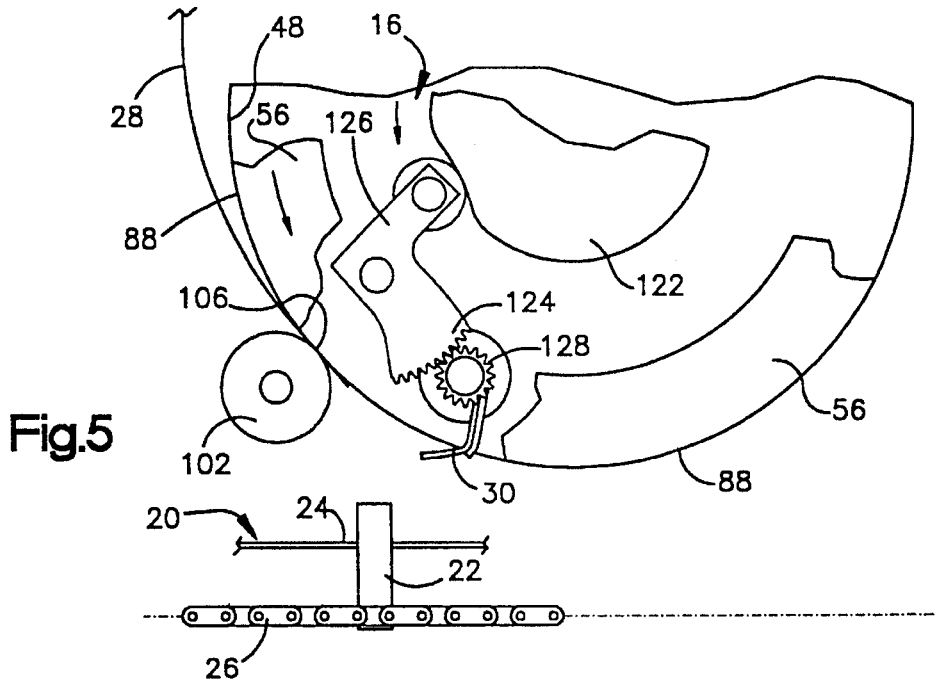
FIG. 5 is a schematic illustration depicting the relationship between a gripper on the feed drum of FIG. 3 and a pusher element on the conveyor.

As the leading edge portion of the sheet material article 28 moves into the nip between the presser rollers 102 and the slow moving ring members 56 and 72, the grippers 30 are opened (FIG. 5). In the illustrated embodiment of the invention, the grippers 30 are operated between the open and closed conditions by a stationary actuator cam 122. Force is transmitted from the actuator cam 122 through a gear segment 124 on a pivotally mounted actuator arm 126 on the feed drum 16. The gear segment 124 on the actuator arm 126 meshes with a gear 128 connected with the gripper 30. The manner in which the gripper 30 is operated between the open and closed conditions by the actuator cam 122 is known and will not be further described herein to avoid prolixity of description.

The cooperation between the presser rollers 102 and the ring members 56 and 72 decelerates or slows down the sheet material article. As the sheet material article 28 moves through the nip 106 the sheet material article is slowed to a speed which is the same as the speed of movement of the pusher elements 22 in the conveyor 20. Therefore, when the leading edge of a sheet material article 28 engages the conveyor 20, the sheet material article is moving at the same speed as the conveyor.

In the embodiment of the invention illustrated in FIGS. 1–4, the ring members 56 and 72 are driven at a substantially constant speed by the ring member drive system 76 while the feed drum 16 is rotated at a substantially constant speed by the feed drum drive system 42. However, in the embodiment of the invention illustrated in FIG. 6, the speed of rotation of the ring members is varied while the speed of rotation of the feed drum remains constant. Since the components of the embodiment of the invention illustrated in FIG. 6 are generally similar to components of the embodiment of the invention illustrated in FIGS. 1–4, similar numerals will be utilized to designate similar components, the suffix letter "a" being added to the numerals of FIG. 6 to avoid confusion.

The feed drum **16*a* is rotated in a counterclockwise direction (as viewed in FIG. 6), at a substantially constant speed by the feed drum drive system 42*a*. The conveyor 20*a* is driven at a substantially constant speed, in the direction of the arrow 50*a*, by the conveyor drive system 44*a*. The speed at which the pusher elements 22*a* in the conveyor 20*a* are moved by the conveyor drive system 44*a* is less than the speed of movement of the grippers 30*a* in the feed drum 16*a*. Therefore, the apparatus 52*a* is provided to decrease the speed of movement of sheet material before it is fed from the feed drum 16*a* to the conveyor 20*a* at the transfer station 32*a***.

Figure 6:
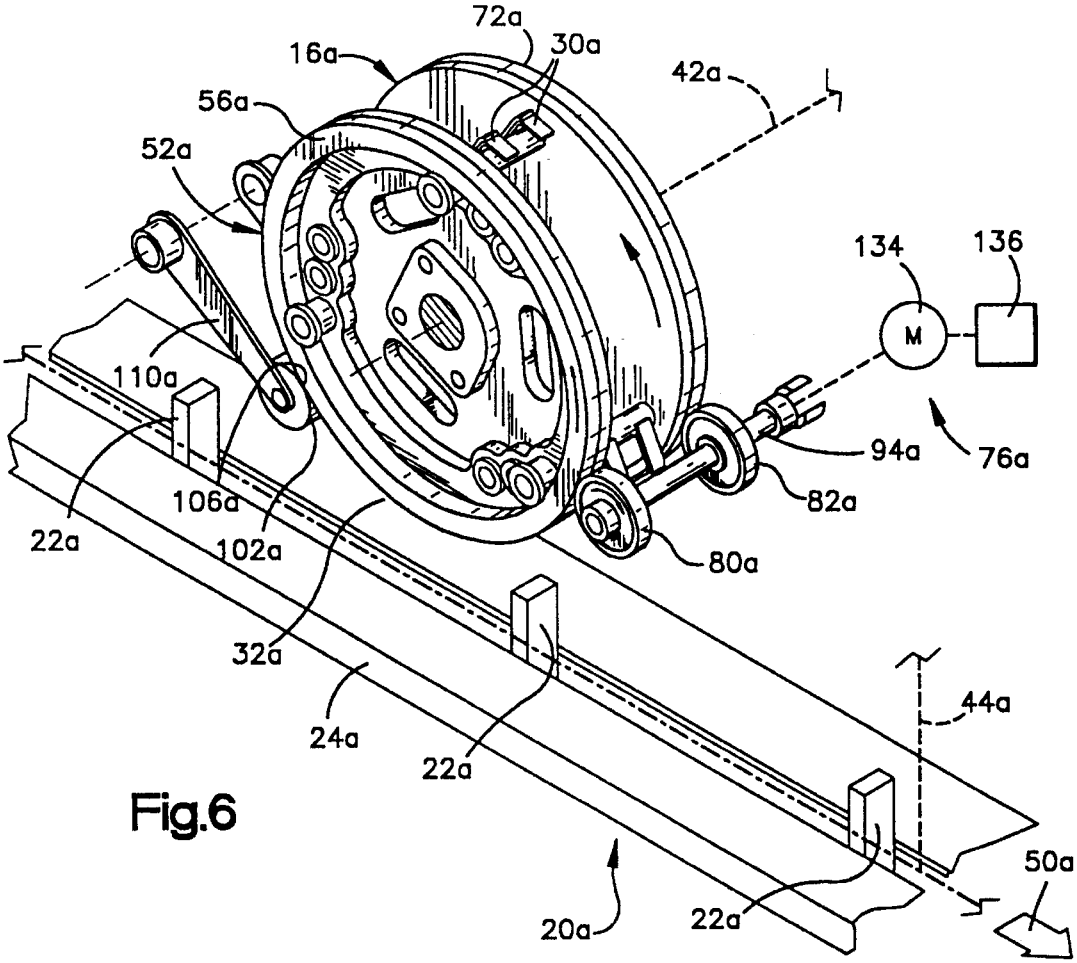
FIG. 6 is a schematic pictorial illustration of a second embodiment of the invention in which a variable speed motor is used to drive an apparatus to change the speed of movement of sheet material.

In accordance with a feature of the embodiment of the invention illustrated in FIG. 6, the ring member drive system **76*a* is operable to vary the speed of movement of the ring members 56*a* and 72*a*. The ring member drive system 76*a* includes a variable speed motor 134 which is connected with the drive shaft 94*a*. The drive shaft 94*a* rotates the drive wheels 80*a* and 82*a* in a clockwise direction, as viewed in FIG. 6. The speed of operation of the motor 134 is varied by a motor controller 136**.

Immediately before rotation of the feed drum **16*a* moves a leading edge portion of a sheet material article into the nips 106*a* between the presser rollers 102*a* and the ring members 56*a* and 72*a*, the motor controller 136 causes the motor 134 to increase the speed of rotation of the ring members 56*a* and 72*a*. Immediately after the leading edge portion of the sheet material has entered the nip 106*a* and the grippers 30*a* have been operated to an open condition, the motor controller 136 causes the speed of operation of the motor 134 to be reduced to reduce the peripheral speed of the ring members 56*a* and 72*a*. This enables the ring members 56*a* and 72*a* to have the same peripheral speed as the speed of movement of a leading edge of the sheet material article as the sheet material article enters the nip 106*a*. The subsequent deceleration of the motor 134 and ring members 56*a* and 72*a* results in the sheet material article being decelerated before it moves onto the conveyor 20*a*. Therefore, when the sheet material article is deposited on the conveyor 20*a***, it is moving at the same speed as the conveyor.

In the embodiments of the invention illustrated in FIGS. 1–6, drive wheels are utilized to rotate the ring members 56 and 72. However, it is contemplated that flexible belts could be used to drive the ring members. If this was done, a flexible belt and an associated drive pulley would be provided for each ring member. The drive pulleys would be driven in the same manner as in which the drive wheels are driven in the embodiments of the invention illustrated in FIGS. 1–6.

Figure 7:
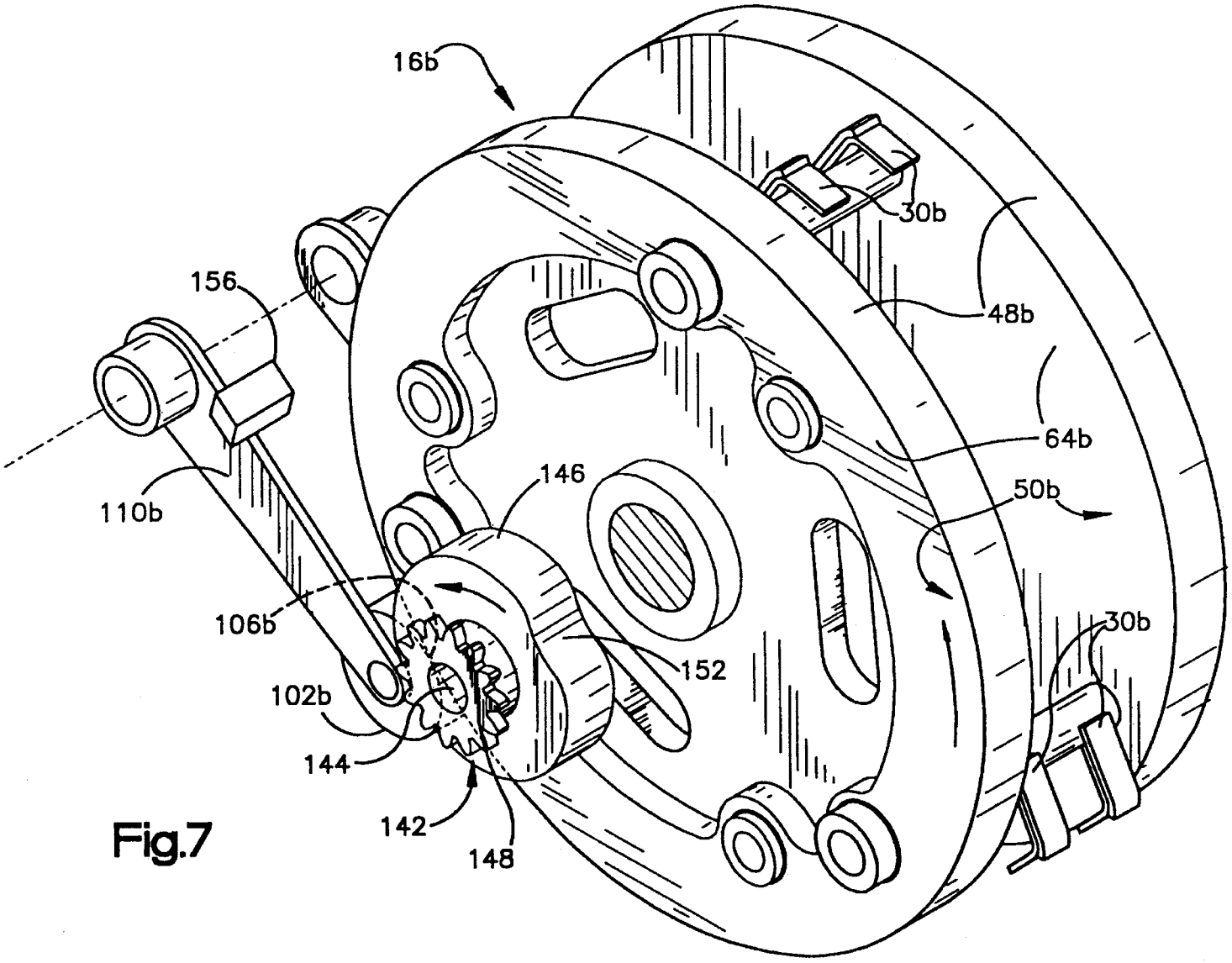
FIG. 7 is a schematic pictorial illustration, generally similar to FIG. 3, of a third embodiment of the invention.

In the embodiment of the invention illustrated in FIGS. 1–5, relatively large diameter ring members 56 and 72 are utilized to change the speed of movement of the sheet material. In the embodiment of the invention illustrated in FIG. 7, relatively small diameter wheels are utilized to change the speed of movement of the sheet material. Since the embodiment of the invention illustrated in FIG. 7 is generally similar to the embodiment of the invention illustrated in FIGS. 1–5, similar numerals will be utilized to indicate similar components, the suffix letter "b" being associated with the numerals of FIG. 7 to avoid confusion.

A feed drum **16*b* (FIG. 7) has a plurality of sets of grippers 30*b* disposed at equally spaced apart locations about peripheral surfaces 48*b* on side walls 50*b* of the feed drum. The grippers 30*b* are spaced apart by a distance, measured along the peripheral surface 48*b* of the feed drum 16*b*, which is greater than spacing between pusher elements in an associated conveyor, corresponding to the conveyor 20 of FIGS. 1 and 2. The speed of movement of the grippers 30*b*** is greater than the speed of movement of pusher elements in the associated conveyor.

In accordance with a feature of this embodiment of the invention, a relatively small diameter wheel 142 cooperates with a presser roller **102*b* to form a nip 106*b* through which the sheet material passes before being deposited at a receiving location on a conveyor. The wheel 142 is supported independently of the feed drum 16*b*. Thus, the wheel 142 is rotatably supported on a shaft 144. The shaft 144** is supported on a stationary frame (not shown).

The wheel 142 has an outer side surface area 146 which forms a portion of a cylinder. The outer side surface area 146 engages a presser roller **102*b* to form a nip 106*b*. The wheel 142 is driven by a drive gear 148 which is fixedly connected with the wheel. The drive gear 148 rotates the wheel 142 at a speed which results in the outer side surface area 146 on the wheel moving at the same speed as pusher elements in a conveyor corresponding to the conveyor 20 of FIGS. 1 and 2. The wheel 142 is rotated in the same direction as the feed drum 16*b*, that is, counterclockwise as viewed in FIG. 7. However, the wheel 142 is rotated at a slower speed than the feed drum 16*b***.

A central axis of the wheel 142 and drive gear 148 extends parallel to and is offset from a central axis of the feed drum **16*b*. The central axis of the wheel 142 extends through the feed drum 16*b* at a location between the central axis of the feed drum 16*b* and the peripheral surfaces 48*b* of the feed drum side walls 50*b*. The wheel 142 is enclosed by a cylindrical spatial plane which contains the peripheral surfaces 48*b* of the side walls 50*b*. At the nip 102*b* , the peripheral surface 146 of the wheel 142 is tangent to the peripheral surface of the cylindrical spatial envelope containing the outer side surfaces 48***b* of the feed drum side walls 50*b*.

The wheel 142 has an arcuately curving and radially inwardly projecting recess 152 in its periphery. The support arm 110*b* for the presser roller 102*b* can move the presser roller only a small distance upward (as viewed in FIG. 7) from a point at which the presser roller engages the cylindrical outer side surface 146 of the wheel 142. Therefore, the presser roller 102*b* can not move into the recess 152. The presser roller 102*b* engages the cylindrical peripheral surface area 146 on the wheel 142 and remains spaced from the portion of the peripheral surface of the wheel which is located in the recess 152.

The entire periphery of the wheel 142 has a circumferential extent which is equal to the distance between pusher elements in the associated conveyor, that is, the distance between the pusher elements 22 of the conveyor 20 of FIG. 2. Rotation of the wheel 142 relative to the feed drum 16*b* and the conveyor is coordinated so that the recess 152 is disposed adjacent to the presser roller 102*b* when a leading edge portion of a sheet material article moves into the nip 106*b* between the presser roller 102*b* and the wheel 142. Since the blocking member 156 prevents movement of the presser roller 102*b* into the recess 152, the grippers 30*b* can move the leading edge portion of a sheet material article into the open space in recess 152.

The grippers 30*b* are operated to an open condition while a leading edge of a sheet material article is in the recess 152 and before the presser roller 102*b* firmly engages the sheet material article. Thus, before the presser rollers 102*b* press the sheet material article against the relatively slow moving cylindrical surface area 146, the leading edge of the sheet material article has entered the recess 152 and the grippers 30*b* have opened. This ensures that the sheet material article will have been fully released by the relatively fast moving grippers 30*b* before the sheet material article is pressed against the slower moving circumferential surface area 146 on the wheel 142 by the presser roller 102*b*. When the presser roller 102*b* presses the sheet material against the surface area 146 on the wheel 142, the sheet material is decelerated to the same speed as an associated conveyor, corresponding to the conveyor 20 of FIGS. 1 and 2.

Although only a single presser roller 102*b* and a single wheel 142 have been shown in FIG. 7, it should be understood that a similar presser roller and wheel are disposed along the opposite side of the feed drum 16*b*. If desired, the speed of movement of the wheel 142 could be varied in the same manner as in which the speed of movement of the ring members 56*a* and 72*a* of the embodiment of FIG. 6 are varied.

In view of the foregoing description, it is apparent that the present invention provides a new and improved sheet material handling apparatus 10 (FIG. 1) for changing the speed of movement of sheet material 28 which is transferred from a feed drum 16 to a conveyor 20. The apparatus includes a nip 106 (FIG. 2) into which a leading edge portion of sheet material is moved by the feed drum 16. The sheet material 28 moves through the nip 106 toward the conveyor 20 at a speed which is the same as the speed of the conveyor.

In one embodiment of the invention, the apparatus includes a ring member 56 which is supported on the feed drum 16 and is rotatable about a central axis of the feed drum. A presser roller 102 engages a peripheral surface 70 on the ring member 56 at the transfer station 32 to form the nip 106 through which the sheet material passes. In another embodiment of the invention, a generally circular member 142 (FIG. 7) is rotated about an axis which is offset from the axis of the feed drum 16*b* and which extends through the feed drum. A presser roller 102*b* engages a peripheral surface 146 on the circular member 142 to form the nip 106*b* through which the sheet material passes.

Having described the invention, the following is claimed:

1. A sheet material handling apparatus comprising a rotatable sheet material feed drum having a gripper which is operable between a closed condition in which said gripper is effective to grip sheet material and an open condition in which said gripper is ineffective to grip sheet material, first drive means for rotating said feed drum to move said gripper and sheet material engaged by said gripper at a first speed, a conveyor having receiving locations which receive sheet material from said feed drum, second drive means for operating said conveyor to move said locations which receive sheet material at a second speed which is different than the first speed, and means for changing the speed of movement of the sheet material from the first speed to a speed which is different than the first speed while said gripper is in the open condition and prior to movement of the sheet material into one of the receiving locations in said conveyor.

2. An apparatus set forth in claim 1 wherein said means for changing the speed of movement of the sheet material includes a ring disposed in a coaxial relationship with said feed drum and means for rotating said ring relative to said feed drum.

3. An apparatus set forth in claim 1 wherein said means for changing the speed of movement of the sheet material includes a member having an arcuate peripheral surface, means for rotating said member to move said arcuate peripheral surface at a speed which is different than the first speed, and means for pressing the sheet material against the arcuate peripheral surface on said member upon operation of said gripper from the closed condition to the open condition.

4. An apparatus set forth in claim 3 wherein said member has a recess in its periphery, said feed drum being operable to move a leading end portion of the sheet material into the recess in the periphery of said member.

5. An apparatus set forth in claim 3 wherein said member is rotatable about an axis which is coincident with an axis about which said feed drum is rotated by said first drive means.

6. An apparatus set forth in claim 3 wherein said member is rotatable about an axis which is offset to one side of and is parallel to an axis about which said feed drum is rotated by said first drive means.

7. An apparatus set forth in claim 1 wherein said means for changing the speed of movement of the sheet material includes a member mounted on said feed drum and movable relative to said feed drum during rotation of said feed drum by said first drive means.

8. An apparatus set forth in claim 1 wherein said means for changing the speed of movement of the sheet material includes a member which is movable relative to said feed drum and variable speed drive means for moving said member relative to said feed drum, said variable speed drive means being operable to move said member at the same speed as said feed drum during at least a portion of the movement of said gripper and the sheet material at the first speed, said variable speed drive means being operable to move said member at a speed which is different than the speed of said feed drum during at least a portion of the movement of said gripper.

9. An apparatus set forth in claim 1 wherein said means for changing the speed of movement of the sheet material includes a rotatable member which is rotatable about an axis which extends parallel to and is offset to one side of an axis about which said feed drum rotates, said axis about which said member rotates and at least a portion of a peripheral surface of said member being disposed within a cylindrical spatial envelope which is defined by said feed drum.

10. An apparatus set forth in claim 1 wherein said means for changing the speed of movement of the sheet material includes a first member supported on and rotatable relative to said feed drum and a second member having an outer side surface which defines a nip into which a leading edge portion of sheet material is moved by said feed drum.

11. An apparatus set forth in claim 10 wherein said means for changing the speed of movement of the sheet material includes variable speed drive means being operable to rotate said rotatable member at the same speed as said feed drum during at least a portion of the movement of said gripper and the sheet material at the first speed, said variable speed drive means being operable to rotate said rotatable member at a speed which is different than the speed of rotation of said feed drum during at least a portion of the movement of said gripper.

12. A sheet material handling apparatus comprising a sheet material feed drum having a periphery and a plurality of grippers which are spaced apart by a first distance as measured along the periphery of said feed drum, first drive means for rotating said feed drum to sequentially move said plurality of grippers and sheet material engaged by said grippers at a first speed to a sheet material transfer station, a sheet material conveyor having a plurality of pusher elements which are spaced apart by a second distance which is less than the first distance, second drive means for operating said sheet material conveyor to sequentially move said pusher elements through the sheet material transfer station at a second speed which is less than the first speed, first and second surface means which are at least partially disposed at the transfer station for defining a nip into which a leading edge portion of sheet material is moved by said feed drum, and third drive means for moving said first surface means at a speed which is less than the first speed to decelerate the sheet material as the sheet material moves through the nip.

13. An apparatus set forth in claim 11 further including a first member supported on and rotatable relative to said feed drum, said first surface means being disposed on said first member.

14. An apparatus set forth in claim 13 further including a second member supported for rotation about an axis which extends parallel to and is offset from a central axis of said feed drum, said second surface means being disposed on said second member.

15. An apparatus set forth in claim 12 further including a first member rotatable about an axis which extends through said feed drum and extends parallel to and is offset from a central axis of said feed drum, said first surface means being disposed on said first member.

16. An apparatus set forth in claim 15 further including a second member supported for rotation about an axis which is offset from a central axis of said feed drum, said second surface means being disposed on said second member.

17. An apparatus as set forth in claim 12 further including a ring disposed in a coaxial relationship with said feed drum, said first surface means being disposed on said ring, said third drive means being operable to rotate said ring at a speed which is less than the first speed at which said first drive means rotates said feed drum.

18. An apparatus as set forth in claim 12 wherein said first surface means includes a first surface area having a circular configuration and a second surface area which forms a recess which extends radially inwardly from the first surface area, said feed drum being operable to move a leading end portion of sheet material into said recess at said transfer station, said second surface means engaging said first surface area to at least partially define the nip.

19. A sheet material handling apparatus comprising a rotatable sheet material feed drum having a gripper which is operable between a closed condition in which said gripper is effective to grip sheet material and an open condition in which said gripper is ineffective to grip sheet material, first drive means for rotating said feed drum to move said gripper and sheet material engaged by said gripper at a first speed, a conveyor having receiving locations which receive sheet material from said feed drum, second drive means for operating said conveyor to move said locations which receive sheet material at a second speed which is different than the first speed, and means for changing the speed of movement of the sheet material from the first speed to a speed which is different than the first speed, said means for changing the speed of movement of the sheet material includes a rotatable member disposed in a coaxial relationship with said feed drum and means for rotating said rotatable member relative to said feed drum.

20. An apparatus set forth in claim 19 wherein said means for changing the speed of movement of the sheet material includes means for pressing the sheet material against said rotatable member upon operation of said gripper from the closed condition to the open condition.

21. An apparatus set forth in claim 20 wherein said rotatable member is rotatable about an axis which is coincident with an axis about which said feed drum is rotated by said first drive means.

22. An apparatus set forth in claim 19 wherein said rotatable member is mounted on said feed drum and is rotatable relative to said feed drum during rotation of said feed drum by said first drive means.

* * * * *